United States Patent [19]

Takegawa

[11] Patent Number: 4,898,213

[45] Date of Patent: Feb. 6, 1990

[54] DEVICE FOR MENDING AND TRIMMING BROKEN WARP YARN

[75] Inventor: Yujiro Takegawa, Ishikawa, Japan

[73] Assignee: Tsudakoma Corp., Ishikawa, Japan

[21] Appl. No.: 276,857

[22] Filed: Nov. 28, 1988

[30] Foreign Application Priority Data

Nov. 26, 1987 [JP] Japan ..... 62-298805

[51] Int. Cl.[4] ..... D03D 49/00

[52] U.S. Cl. ..... 139/1 R; 139/291 C; 139/353

[58] Field of Search ..... 139/351, 1 R, 353, 291 C

[56] References Cited

U.S. PATENT DOCUMENTS 1,832,522 11/1931 Ahlin ..... 139/351
2,737,981 3/1956 Pfarrwaller ..... 139/1 R
4,791,967 12/1988 Vandeweghe et al. ..... 139/353

FOREIGN PATENT DOCUMENTS 62-69851 3/1987 Japan .

*Primary Examiner*—Andrew M. Falik
*Attorney, Agent, or Firm*—Wenderoth, Lind & Ponack

[57] ABSTRACT

A device for mending and trimming broken warp yarn includes a yarn holder mounted on a moving member for holding a free end of a mending yarn tied to a broken warp yarn. When a warp yarn is broken during the operation of the loom, one end of a mending yarn and the broken end of the broken warp yarn extending from the warp beam are tied together, and the other end of the mending yarn is passed through a corresponding heddle and a corresponding gap between the dents of a reed, and then the loom is restarted. A signaling device generates a signal after detecting the arrival of the free end of the mending yarn which was not woven into the cloth after the loom was restarted. The free end of the mending yarn is cut off automatically from the woven cloth by a cutter in accordance with the signal from the signaling device while the loom is in operation. A controller is connected to and controls all of the elements of the mending and trimming device.

4 Claims, 5 Drawing Sheets

DEVICE FOR MENDING AND TRIMMING BROKEN WARP YARN

BACKGROUND OF THE INVENTION

1. Technical Field of the Invention

The present invention relates to a device for mending and trimming broken warp yarn, in which, in mending a broken warp yarn, one end of a mending yarn is tied to the broken warp yarn and the other end of the mending yarn is passed through the heddle and the reed; the loom is then restarted, and the free end of the mending yarn is then cut automatically during a weaving operation.

2. Description of the Related Art

When a warp yarn is broken during a weaving operation, a dropper device or the like generates a warp stop signal to stop the loom automatically. Then, an operator picks up the broken warp yarn from a series of parallel warp yarns, ties a mending yarn to the leading broken end of the broken warp yarn, passes the mending yarn through the heddle and the reed, and restarts the loom while holding the free end of the mending yarn near the cloth fell by hand or with a magnetic clipper. After a sufficient length of the mending yarn has been woven in the cloth, the operator cuts off the free end of the knot of the warp yarn and the mending yarn projecting from the surface of the woven cloth.

Such a conventional mending operation is carried out entirely manually by the operator, which is inefficient. Moreover, the hand of the operator holding the free end of the mending yarn is exposed to the danger of being struck by the reed and it is possible that the reed is damaged by the cutter in cutting off the free ends of the knot.

SUMMARY OF THE INVENTION

Accordingly, it is an object of the present invention to enable the automatic removal of the free end of the mending yarn in mending the broken warp yarn.

As mentioned above, the dropper device or the like generates a warp stop signal to stop the loom automatically when a warp yarn is broken during weaving operation. The position of the broken warp yarn corresponds to the position of a dropper which has fallen. The broken warp yarn is picked up from the warp yarns, for example, by a device in accordance with the invention: "A Method of Automatically Extracting a Broken Warp Yarn and a Device for Carrying out the Same" disclosed in Japanese Laid-Open Patent Publication No. 62-69851. An operator then ties the broken warp yarn extending from the warp beam to a mending yarn by hand or with an automatic knotter. The mending yarn is then passed through the heddle and the reed, and is extended toward the cloth fell.

The free end of the mending yarn is subsequently removed automatically by the present invention. A moving member of a mending yarn trimming device first moves, together with a yarn holding member, widthwise of the cloth from a standby position near the selvedge of the cloth, and stops near the broken warp yarn, secondly; the yarn holding member holds the free end of the mending yarn at a fixed tension. In this state, the loom is ready to restart. A start signal is provided to restart the loom. The free end portion of the mending yarn positioned toward the cloth fell from the shed, is not woven when the loom is restarted, but remains floating over the cloth and advances as the loom proceeds with the weaving operation. On the other hand, the sensor of the mending yarn trimming device provides an actuation signal to a cutter upon the detection of the arrival of the free end of the mending yarn projecting from the cloth at a predetermined position. Then, the cutter cuts off the free end of the mending yarn at a position near the root to remove the unnecessary free end of the mending yarn. Naturally, in cutting off the unnecessary portion of the mending yarn, an end of the unwoven mending yarn is held by the just woven cloth and the other free end of the mending yarn is held by the yarn holding member to keep the mending yarn at a predetermined tension to facilitate cutting off the unnecessary portion of the mending yarn with the cutter.

Thus, the free end of the mending yarn is removed automatically. Naturally, the various steps of the mending yarn trimming operation are controlled by a controller.

Thus, according to the present invention, the free end of the mending yarn projecting from the upper surface of the cloth is cut off automatically. Furthermore, according to the present invention, the woven fabric containing the broken warp yarn is simultaneously subjected to trimming. Therefore, the operator can be disengaged from the broken warp mending operation as soon as the operator has provided a signal to restart the loom, so that the operator is able to start the next operation. Since the free end of the mending yarn is removed mechanically, the operator need not perform any dangerous work in mending a broken warp yarn, and damage to the reed or to the cloth attributable to faulty work are prevented.

The above and other objects, features and advantages of the present invention will become more apparent from the following description taken in conjunction with the accompanying drawings.

DETAILED DESCRIPTION OF THE PREFERRED EMBODIMENTS

Figure 1:
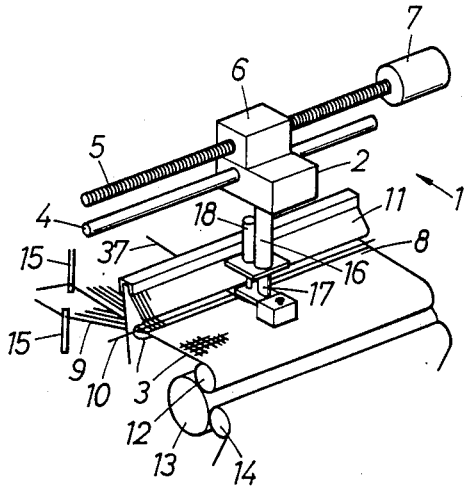
FIG. 1 is a schematic perspective view of a mending yarn trimming device of a first embodiment according to the present invention.

First Embodiment (FIGS. 1 through 5):

A mending yarn trimming device 1 is mounted on a moving member 2, which in turn is supported on a guide rail 4 extended widthwise of the loom over a woven cloth 3 for movement in the direction of the width of the loom. The moving member 2 is moved to a desired position by a driving device including, for example, a driving screw 5, a driven nut 6 and a motor 7. Parallel warp yarns 9 arranged in a sheet are controlled by the vertical motions of heddles 15 to form a shed, a weft yarn 10 is picked into the shed across the warp yarns 9 and is beaten with a reed 11 into the cloth fell 8 to form the woven cloth 3. The woven cloth 3 is drawn by guide rollers 12 and 14 and a take-up roller 13.

The mending yarn trimming device 1 has a tubular holder 16 descending vertically from the lower surface of the moving member 2, and a suction pipe 17, namely, a yarn holding member, attached to the lower end of the tubular holder 16. The suction pipe 17 is vertically retractable into the tubular holder 16 and is connected by a connecting plate 20 to the piston rod 19 of an actuator 18 fixed to the tubular holder 16 to move the suction pipe 17 in a vertical direction. A cutter 23 is supported at one end thereof on the side of the take-up system on the connecting plate 20 by a vertical supporting rod 21 and is urged downward by a coil spring 22 mounted on the supporting rod 21. The cutter 23 is connected at the rear end thereof to a cutter driving unit 24. The cutter driving unit 24 has a guide rod 25 slidable in a vertical direction relative to the connecting plate 20. The upper end of the suction pipe 17 is connected through a waste yarn container 26 formed of a net, and a solenoid valve 27 to a vacuum source 28. A signaling device 29, for example, a photoelectric sensor, is provided on the lower end of the suction pipe 17 on the side of the take-up system.

Figure 5:
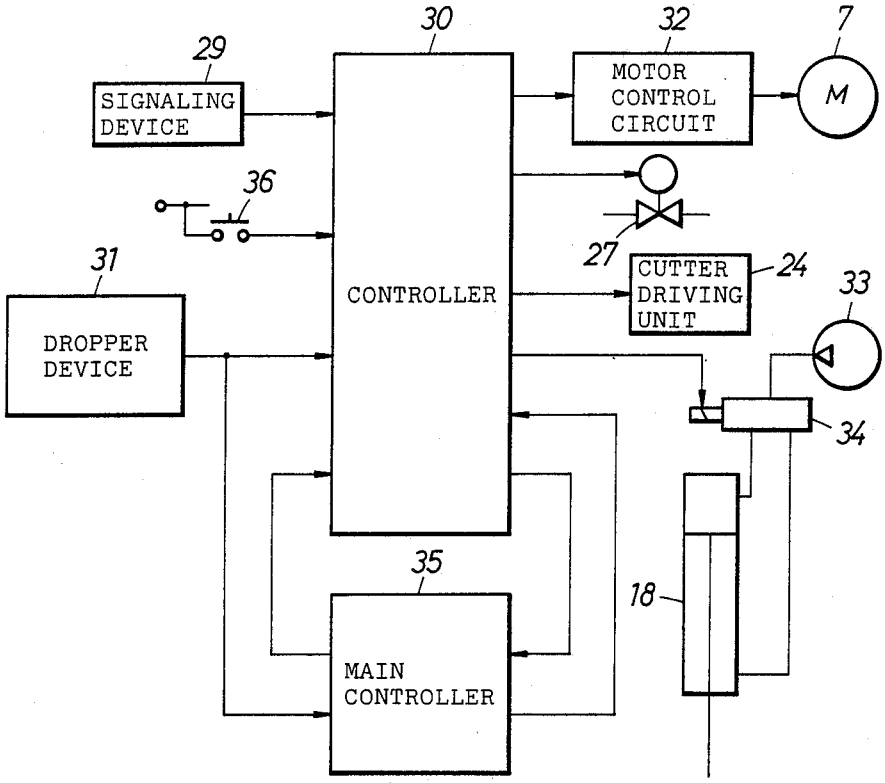
FIG. 5 is a block diagram showing a control system for controlling the mending yarn trimming device of FIG. 1.

A controller 30 controls the operation of the mending yarn trimming device 1 according to a control program in accordance with a method of the present invention. As shown in FIG. 5, the input section of the controller 30 is connected to the signaling device 29, a dropper device 31 and a command switch 36, while the output section of the controller 30 is connected to a motor control circuit 32 for controlling the driving motor 7, a selector valve 34 disposed in a line interconnecting the actuator 18 to a pressure source 33, and a cutter driving unit 24. Both the input section and output section of the controller 30 are connected bilaterally to the main controller 35 of the loom.

The operation of the mending yarn trimming device 1 will be described hereinafter.

While the loom is in operation, the moving member 2 is held in a standby position near one of the selvedges of the woven cloth 3 so that the weaving operation of the loom will not be interfered with by the mending yarn trimming device 1.

Figure 6:
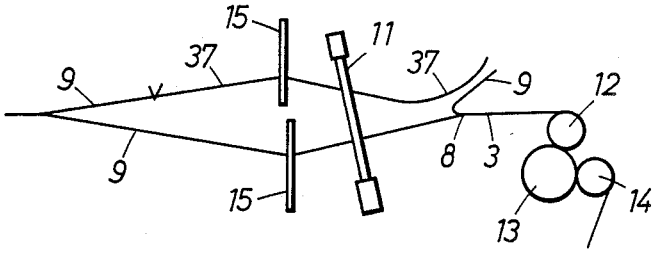
FIG. 6 is a fragmentary, schematic side elevation of a loom.

Upon the detection of the breakage of the warp yarn 9, the dropper device 31 provides a warp stop signal to the main controller 35 of the loom. Then, the main controller 35 stops the loom automatically at a predetermined stopping phase angle. Then, as shown in FIG. 6, the aforesaid automatic broken warp extracting device of Japanese Laid-open Patent Publication No. 62-69851 picks up the free end of the broken warp yarn 9 extending from the warp beam, ties the broken warp yarn 9 and a mending yarn 37 together and passes the free end of the mending yarn 37 through the corresponding heddle 15 and the corresponding gap between the dents of the reed 11 to pull out the free end of the mending yarn 37 on the side of the cloth fell 8. The above-noted operations shown in FIG. 6 may also be manually performed by the operator of the loom. Then, the operator operates the command switch 36 to give a start signal to the controller 30. Then, the controller 30 starts controlling the mending yarn trimming device 1 according to a predetermined control program to carry out an operation necessary for trimming the mending yarn 37.

Figure 2:
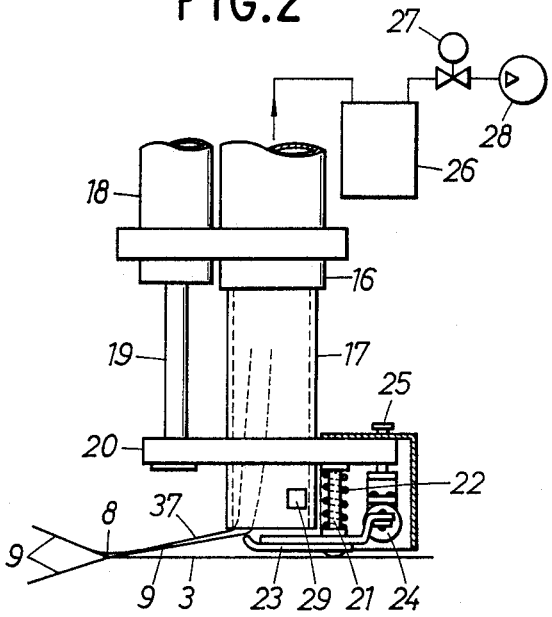
FIGS. 2 and 3 are enlarged side elevations showing a portion of the mending yarn trimming device of FIG. 1.
Figure 3:
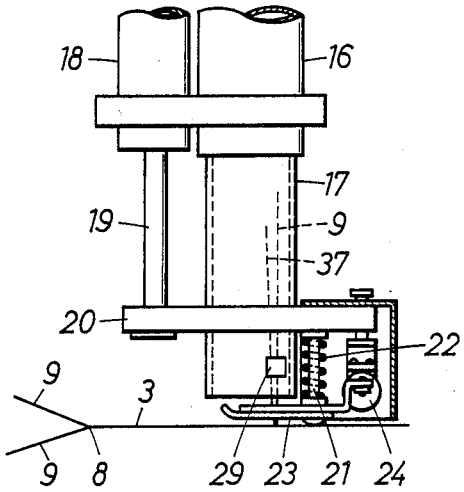
Figure 4:
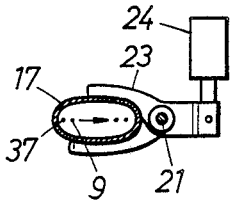
FIG. 4 is a horizontal sectional view showing a guide tube and a cutter incorporated into the mending yarn trimming device of FIG. 1.
Figure 7:
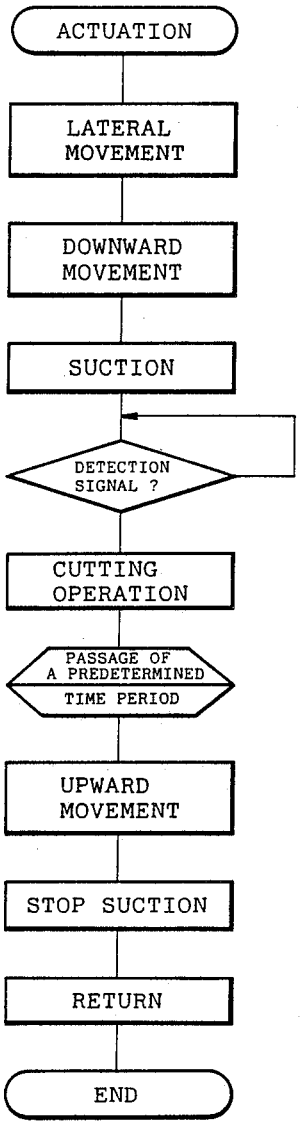
FIG. 7 is a flow chart for explaining the operation of the mending yarn trimming device of FIG. 1.

Referring to FIG. 7, first, the controller 30 drives the driving motor 7 on the basis of information about the position to the broken warp yarn 9 provided thereto by the dropper device 31 to move the moving member 2 to a position corresponding to the broken warp yarn 9; the controller 30 then controls the selector valve 34 to lower the suction pipe 17 by the actuator 18 to a position above the cloth fell 8, and then opens the solenoid valve 27 to generate an air current flowing into the suction pipe 17. Then, the free ends of the mending yarn 37 and the broken warp yarn 9 are sucked into the suction pipe 17 by the air current. In this state, since the free ends of the broken warp yarn 9 and the mending yarn 37 extending toward the cloth are extending within the suction pipe 17 on the side of the cloth fell 8 as shown in FIG. 2, the free ends of the broken warp yarn 9 and the mending yarn 37 are outside the range of detection of the signaling device 29. Then, the operator provides a start signal to the main controller 35 to restart the loom for performing a weaving operation. As the loom proceeds with the weaving operation, the free end portion of the mending yarn positioned toward the cloth fell from the shed and the free end of a portion of the broken warp yarn 9 extending from the cloth 3 are not woven but remain floating above the cloth 3 and move gradually toward the take-up system, and finally, enter the region of detection of the signaling device 29. Upon the detection of the free end of the mending yarn 37, the signaling device 29 provides a detection signal to the controller 30. In this state, the free end of the mending yarn 37 and the free end of the broken warp yarn 9 are both within the suction pipe 17 and are both disposed in a cutting range and are both under tension. Upon the reception of the detection signal from the signaling device 29, the controller 30 actuates the cutter driving unit 24 to cut of the free ends of the mending yarn 37 and the broken warp yarn 9 extending from the cloth 3 with the cutter 23 so that the free ends of the mending yarn 37 and the broken warp yarn 9 project by a predetermined length from the upper surface of the cloth 3. Since air is sucked continuously into the suction pipe 17 during this cutting operation, the cut free ends of the mending yarn 37 and the broken warp yarn 9 are delivered by the air current to the waste yarn container 26.

Subsequently, the controller 30 controls the selector valve 34 for a predetermined time period after cutting the free ends of the mending yarn 37 and the broken warp yarn 9 to cause the actuator 18 to raise the suction pipe 17, and to close the solenoid valve 27 to stop the suction of the suction pipe 17, and then, or simultaneously with the operation for stopping the suction of the suction pipe 17, to control the motor control circuit 32 to return the mending yarn trimming device 1 to its predetermined standby position, thus completing a series of control operations.

Figure 8:
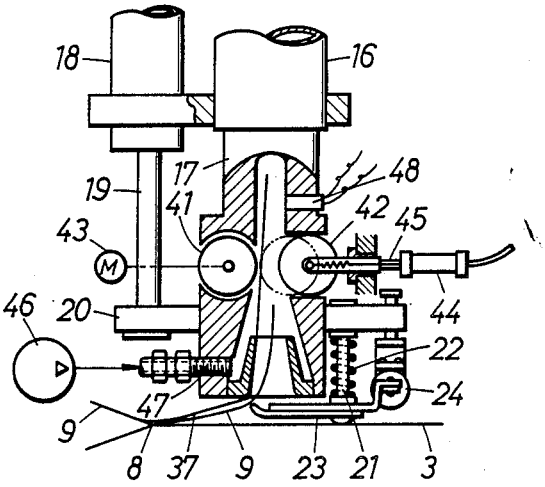
FIGS. 8 and 9 are enlarged side elevations respectively showing portions of second and third embodiments of the present invention.

Second embodiment (FIG. 8):

A mending yarn trimming device in accordance with a second embodiment of the present invention incorporates a pair of drawing rollers 41 and 42 disposed within a suction pipe 17. The drawing roller 41 is a driving roller disposed at a fixed position so as to be driven by a motor 43. The other drawing roller 42 is a driven roller rotatably supported on the extremity of the piston rod 45 of a pneumatic actuator 44 so as to be pressed against the driving drawing roller 41. In the second embodiment, the suction pipe 17 is not connected to any vacuum source 28; a venturi tube 47 is formed within and at the lower end of the suction pipe 17. Pressurized air is supplied from a pressurized air source 46 into the suction pipe 17 so that a suction is generated at the lower end of the suction pipe 17 by the cooperative agency of the suction pipe 17 and the venturi tube 47. A yarn detector 48 is provided on the suction pipe 17 above the pair of drawing rollers 41 and 42.

When air is blown through the venturi 47, a suction is generated at the lower end of the suction pipe 17 to suck the free end of a mending yarn 37 into the suction pipe 17, and then the yarn detector 48 detects the presence of the free end of the mending yarn 37 within the suction pipe 17. After the loom has been restarted, the pneumatic actuator 44 advances the piston rod 45 to press the driven drawing roller 42 against the driving drawing roller 41. Then, the controller 30 actuates the motor 43 to drive the driving drawing roller 41 at a circumferential speed corresponding to the moving speed of the cloth 3 during the weaving operation, so that the mending yarn is drawn at a speed corresponding to the moving speed of the cloth 3. A signaling device 29 capable of measuring a predetermined time period from the restart of the loom or a predetermined number of picking cycles from the restart of the loom provides a signal to the controller 30 to actuate the cutter 23 to cut off the free end of the mending yarn 37 after a predetermined time period or after a predetermined number of picking cycles from the restarting of the loom. The signaling device 29 is a timer or a pick counter. The cut free end of the mending yarn 37 is drawn further by the drawing rollers 41 and 42 and, eventually, leaves the drawing rollers 41 and 42. Then, the mending yarn 37 is carried by an air current to a predetermined place. The rest of the operating steps of the mending yarn trimming device of the second embodiment are the same as those of the mending yarn trimming device of the first embodiment. The pressurized air is blown continuously into the suction pipe 17 while the free end of the mending yarn 37 is nipped between the pair of drawing rollers 41 and 42. However, the supply of the pressurized air into the suction pipe 17 may be interrupted during the operation of the pair of drawing rollers 41 and 42 to avoid breaking the mending yarn 37 by the untwisting action of the air current.

Figure 9:
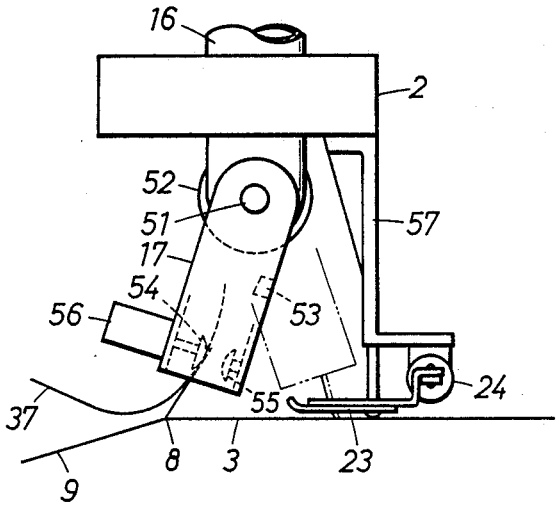

Third Embodiment (FIG. 9):

A suction pipe 17 incorporated into a mending yarn trimming device in accordance with a third embodiment of the present invention is not placed at a fixed position with respect to the moving member 2. The suction pipe 17 is supported pivotally for enabling a swinging motion on the tubular holder 16 by a horizontal shaft 51 so that the lower end thereof is able to move along the direction of extension of the warp yarns 9. The suction pipe 17 is driven for the swinging motion by a motor 52. The free end of the mending yarn 37 is sucked into the suction pipe 17 by an air current flowing into the suction pipe 17. A mending yarn detector 53 detects the free end of the mending yarn 37 sucked into the suction pipe 17, and then a pair of clamping members 54 and 55 clamp the free end of the mending yarn 37. One of the clamping members 54 and 55, namely, the clamping member 54 in this embodiment, is driven by an actuator 56, such as a pneumatic actuator or an electromagnetic actuator.

As the mending yarn 37 moves in the take-up direction in synchronism with the weaving operation of the loom, the suction pipe 17 is driven by the motor 52 so as to move in the direction of movement of the cloth 3 as the cloth 3 moves so that the mending yarn 37 is kept under tension. Upon the arrival of the mending yarn 37 at a cutting position, the cutter 23 is actuated to cut off the free ends of the mending yarn 37 and the broken warp yarn 9 projecting from the upper surface of the cloth 3. The cutter 23 is held on a bracket 57 fixed to the moving member 2.

In the foregoing embodiment, the loom is restarted by the operator after the free ends of the mending yarn 37 and the broken warp yarn 9 have been sucked into the suction pipe 17. However, when a yarn detector is provided within the suction pipe 17 to detect the suction of the free ends of the mending yarn 37 and the broken warp yarn 9, the loom can be restarted automatically, and hence the operator needs only to provide a start command to the controller 30 after passing the free end of the mending yarn 37 through the corresponding heddle 15 and the corresponding gap between the dents of the reed 11.

Figure 10:
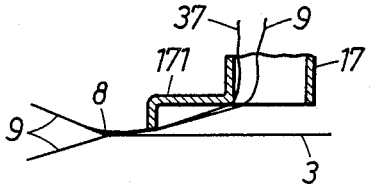
FIG. 10 is a sectional view of a portion of a fourth embodiment of the present invention.

Fourth Embodiment (FIG. 10):

A mending yarn trimming device in accordance with a fourth embodiment of the present invention is substantially the same as that in the first embodiment, except that the mending yarn trimming device in the fourth embodiment employs a suction pipe 17 having a guide 171 to guide the mending yarn 37 along the surface of the cloth 3 so that the mending yarn 37 can surely be woven into the cloth.

Although the invention has been described in its preferred form with a certain degree of particularity, it is to be understood that many variations and changes are possible in the invention without departing from the scope thereof.

What is claimed is:

1. A device for mending and trimming broken warp yarn for a loom comprising:
   - a moving member supported above a woven cloth for movement widthwise along the woven cloth;
   - a yarn holding means mounted on the moving member to hold a free end of a mending yarn which has been tied to a broken warp yarn so that the free end of the mending yarn is extending substantially under tension;
   - a signaling device which generates a signal upon the detection of arrival of the free end of the mending yarn at a predetermined position;
   - a cutter for cutting the free end of the mending yarn extending from the woven cloth so that a predetermined length of the mending yarn remains on the woven cloth; and
   - a controller for controlling the moving member, the yarn holding means and the cutter for operation according to a predetermined control program, the moving member, yarn holding means, and cutter being controlled so as to automatically cut off the free end of the mending yarn extending from the woven cloth by a predetermined length from the woven cloth.

2. A device according to claim 1, wherein the yarn holding means comprises a suction pipe through which an air current flows.

3. A device according to claim 1, wherein the yarn holding means comprises a suction pipe through which an air current flows, and a pair of drawing rollers disposed within the suction pipe so as to be driven for rotation by a driving means at a circumferential speed equal to the moving speed of the woven cloth.

4. A device according to claim 1, wherein the yarn holding means comprises a suction pipe which is supported by a supporting means for motion in a direction of extension of the warp yarns, and a pair of clamping members provided within the suction pipe.

* * * * *